US007121212B2

(12) United States Patent
Schorr et al.

(10) Patent No.: US 7,121,212 B2
(45) Date of Patent: Oct. 17, 2006

(54) RIDE CONTROL CONSTANT CONTACT SIDE BEARING ARRANGEMENT

(75) Inventors: Ralph H. Schorr, Edwardsville, IL (US); Dan Schniers, Damiansville, IL (US)

(73) Assignee: ASF-Keystone, Inc., Granite City, IL (US)

( * ) Notice: Subject to any disclaimer, the term of this patent is extended or adjusted under 35 U.S.C. 154(b) by 19 days.

(21) Appl. No.: 10/808,535

(22) Filed: Mar. 25, 2004

(65) Prior Publication Data

US 2004/0187726 A1 Sep. 30, 2004

Related U.S. Application Data

(60) Provisional application No. 60/457,311, filed on Mar. 26, 2003.

(51) Int. Cl.
*B61F 5/00* (2006.01)

(52) U.S. Cl. ..... 105/199.3; 384/423

(58) Field of Classification Search ..... 105/199.3, 105/199.4, 453, 199.1; 384/423
See application file for complete search history.

(56) References Cited

U.S. PATENT DOCUMENTS 3,735,711 A * 5/1973 Hassenauer ..... 105/199.3
3,748,001 A 7/1973 Neumann et al.
4,130,066 A 12/1978 Mulcahy
4,924,779 A * 5/1990 Curtis et al. ..... 105/4.1
4,998,997 A * 3/1991 Carlston ..... 267/3
5,036,774 A 8/1991 Curtis et al.
5,315,934 A 5/1994 List, deceased et al.
5,601,031 A 2/1997 Carlson
5,806,435 A * 9/1998 Pitchford ..... 105/199.3
6,357,732 B1 3/2002 Etzel et al.
6,644,214 B1 * 11/2003 Schorr ..... 105/199.3

OTHER PUBLICATIONS

Miner Enterprises Inc.—Constant Contact Side Bearings—TCC III Series—Long Travel; http://www.minerent.com/longtravel.html, Feb. 11, 2003; pp. 1-2.
Stucki Extended Travel Metal Capped Constant Contact Side Bearings; http://www.stucki.com/products/L.T.asp; Feb. 11, 2003, pp. 1-2.
TecsPak Constant Contact Side Bearings; "Inspection Pocket Guide", Miner Enterprises, Inc.; pp. 1-28; (2002).

* cited by examiner

*Primary Examiner*—Mark T. Le
(74) *Attorney, Agent, or Firm*—Oliff & Berridge, PLC; Edward J. Brosius

(57) ABSTRACT

A long travel constant contact side bearing for railway cars provides better handling characteristics, achieving improved tracking and curving through use of various combinations of features. Such a long travel side bearing is able to meet recent stringent American Association of Railroads standards, such as M-976. Lowered spring rates, preferably less than 6,000 lb/in., help with stability and reduce set-up sensitivity. Reduced cap and base dimensions and spring design help achieve travel of at least ⅝". A visual inspection windows allows ready inspection. Increased service life and wear characteristics are obtained by addition of hardened wear surfaces, improved tolerances, changes to Grade E steel, increase of top contact surface flatness and coped top surface peripheral edges. Standardized sets of spring components can be mixed and matched, requiring fewer specialty parts. Interchangeability of improper components can be prevented by a combination of keying features and/or spring lockout features.

21 Claims, 12 Drawing Sheets

| SET # | SPRING | BAR DIAMETER | OUTSIDE DIAMETER | SOLID HEIGHT | FREE HEIGHT | TRAVEL | LOAD RATE | SOLID LOAD | SOLID STRESS | LOADED HEIGHT | LOAD @ HEIGHT |
|---|---|---|---|---|---|---|---|---|---|---|---|
| | 130A | 0.94 | 5.72 | 3.75 | 5.30 | 1.55 | 3607 | 5590 | 125553 | 4.56 | 2660 |
| 1 | 130B | 0.66 | 3.70 | 3.75 | 5.25 | 1.50 | 2084 | 3125 | 125562 | 4.56 | 1432 |
| | 130C | 0.44 | 2.20 | 3.75 | 5.00 | 1.25 | 1298 | 1623 | 129544 | 4.56 | 568 |
| | | | | | | | 6989 | | | | 4660 |
| | 130A | 0.94 | 5.72 | 3.75 | 5.30 | 1.55 | 3607 | 5590 | 125553 | 4.56 | 2660 |
| 2 | 130B | 0.66 | 3.70 | 3.75 | 5.45 | 1.70 | 1563 | 2658 | 123090 | 4.56 | 1388 |
| | 130C | 0.44 | 2.30 | 3.88 | 5.30 | 1.43 | 1059 | 1509 | 124716 | 4.56 | 781 |
| | | | | | | | 6229 | | | | 4828 |
| | 130A | 0.94 | 5.72 | 3.75 | 5.30 | 1.55 | 3607 | 5590 | 125553 | 4.50 | 2885 |
| 3 | 130B | 0.66 | 3.70 | 3.75 | 5.25 | 1.50 | 2084 | 3125 | 126562 | 4.50 | 1563 |
| | 130C | 0.44 | 2.30 | 3.88 | 5.30 | 1.43 | 1059 | 1509 | 124716 | 4.50 | 847 |
| | | | | | | | 6750 | | | | 5295 |
| | 130A | 0.94 | 5.72 | 3.75 | 5.30 | 1.55 | 3607 | 5590 | 125553 | 4.44 | 3111 |
| 4 | 130B | 0.66 | 3.70 | 3.75 | 5.25 | 1.50 | 2084 | 3125 | 126562 | 4.44 | 1693 |
| | 130C | 0.44 | 2.20 | 3.75 | 5.00 | 1.25 | 1298 | 1623 | 129544 | 4.44 | 730 |
| | | | | | | | 6989 | | | | 5534 |
| | 130A | 0.94 | 5.72 | 3.68 | 5.30 | 1.62 | 3705 | 6003 | 135345 | 4.44 | 3196 |
| 5 | 130B | 0.66 | 3.70 | 3.68 | 5.25 | 1.57 | 2134 | 3350 | 135977 | 4.44 | 1734 |
| | 130C | 0.44 | 2.23 | 3.68 | 5.00 | 1.32 | 1261 | 1665 | 134589 | 4.44 | 710 |
| | | | | | | | 7097 | | | | 5639 |
| | 130A | 0.88 | 5.70 | 3.68 | 5.72 | 2.04 | 2483 | 5065 | 137012 | 4.44 | 3184 |
| 6 | 130B | 0.63 | 3.75 | 3.68 | 5.56 | 1.88 | 1525 | 2871 | 134812 | 4.44 | 1716 |
| | 130C | 0.38 | 2.25 | 3.68 | 5.75 | 2.07 | 498 | 1031 | 129039 | 4.44 | 654 |
| | | | | | | | 4506 | | | | 5554 |

Fig. 18

RIDE CONTROL CONSTANT CONTACT SIDE BEARING ARRANGEMENT

This nonprovisional application claims the benefit of U.S. Provisional Application No. 60/457,311, filed Mar. 26, 2003. The entire disclosure of the prior application is hereby incorporated by reference herein in its entirety.

BACKGROUND OF THE INVENTION

1. Field of Invention

The present invention relates to an improved side bearing design for mounting on a railroad car truck bolster that allows long travel, substantial weight reduction, improved hunting and curving characteristics, and various safety features.

2. Description of Related Art

In a typical railway freight train, such as that shown in FIG. 1, railway cars 12, 14 are connected end to end by couplers 16, 18. Couplers 16, 18 are each received in draft sills 20, 22 of each respective car along with hydraulic cushioning or other shock-absorbing assemblies (unshown). Draft sills 20, 22 are provided at the ends of the railway car's center sill, and include center plates that rest in center plate bowls of railway car trucks 26, 28.

As better shown in FIG. 2, each typical car truck 26 includes a pair of side frames 30, 32 supported on wheel sets 34, 36. A hollow bolster 38 extends between and is supported on springs 40 mounted on the side frames. A bolster center plate 24 is provided having a central opening 42. The bolster center plate bowl 24 receives and supports a circular center plate of the draft sill 20. Side bearing pads 60 are provided laterally to each side of center plate 24 on bolster 38. Side frames 30, 32 comprise a top member 44, compression member 46, tension member 48, column 50, gib 52, pedestal 54, pedestal roof 56, bearing 58 and bearing adapter 62.

Constant contact side bearings are commonly used on railroad car trucks. They are typically located on the truck bolster, such as on side bearing pads 60, but may be located elsewhere. Some prior designs have used a single helical spring mounted between a base and a cap. Others use multiple helical springs or elastomer elements. Exemplary known side bearing arrangements include U.S. Pat. No. 3,748,001 to Neumann et al. and U.S. Pat. No. 4,130,066 to Mulcahy, the substance of which are incorporated herein by reference in their entirety.

Typical side bearing arrangements are designed to control hunting of the railroad car. That is, as the semi-conical wheels of the railcar truck ride along a railroad track, a yaw axis motion is induced in the railroad car truck. As the truck yaws, part of the side bearing is made to slide across the underside the wear plate bolted to the railroad car body bolster. The resulting friction produces an opposing torque that acts to prevent this yaw motion. Another purpose of railroad car truck side bearings is to control or limit the roll motion of the car body. Most prior side bearing designs limited travel of the bearings to about 5/16". The maximum travel of such side bearings is specified by the Association of American Railroads (AAR) standards. Previous standards, such as M-948-77, limited travel to 5/16" for many applications.

New standards have evolved requiring side bearings that have improved hunting, curving and other properties to further increase the safety and design of railcars. The most recent AAR standard is M-976 that now allows for long travel side bearings and has several new requirements, such as new specifications for bearing preloads. Preload is defined as the force applied by the spring element when the Constant Contact Side Bearing is set at the prescribed height.

SUMMARY OF THE INVENTION

There is a need for improved side bearings for railroad cars that can meet or exceed these new AAR standards, such as M-976 or Rule 88 of the AAR Office Manual.

There also is a need for side bearings with better wear characteristics to increase service life.

There further is a need for side bearings that can be designed for a particular application by incorporating design features that prevent interchangeability of incorrect components for that application.

There also is a need for a side bearing which maintains the preload force within 10% of the new condition for a long time. Preferably, this condition should be a minimum of 10 years or one million miles.

There also is a need for redesigned spring rates to improve handling characteristics of the truck and railway car.

There also is a need for a standardized set of springs that can reduce parts inventories of various custom spring sizes.

The above and other advantages are achieved by various embodiments of the invention.

In exemplary embodiments, long travel can be achieved in a side bearing arrangement for railroad car trucks by a combination of features, including reduction of base and/or cap heights and/or reduction of the spring solid height to accommodate 5/8" travel or more before the spring is fully compressed (solid) and before the base and cap bottom out.

In exemplary embodiments, substantial weight reduction is achieved by reducing sides and thicknesses of the base and cap in areas not needed for structural rigidity.

In exemplary embodiments, improved inspection capabilities are achieved by addition of an inspection slot to the base and increasing a corresponding side cutout in the cap to provide a viewing window of considerable size that allows inspection of the spring and other internal components of the side bearing during use. This feature also is able to achieve weight saving advantages over prior designs.

In exemplary embodiments, various design features are incorporated to the base and/or cap to prevent interchangeability with improper components. This may include features that allow mating of only matching base and cap components. Such mating may further include features that prevent improper orientation of the base relative to the cap. Such interchangeability prevention features may further include features that prevent use of improper spring(s) with the matching base and cap. Also, the springs can be wound in the opposite direction of the adjacent spring to preclude one spring interfering with the travel of this adjacent spring.

In exemplary embodiments, improved, longer fatigue life is achieved by increasing the hardness of the components from Grade C to Grade E.

In exemplary embodiments, improved operation of the side bearing, including improved control and hunting characteristics, is achieved by careful control of longitudinal clearances between the cap and base. This has been found to be important to prevent excessive movement between the cap and base, as well as reduce associated impact forces, stresses and wear.

In exemplary embodiments, improved characteristics of the side bearing and service life are achieved by strategic placement of hardened wear surfaces.

In exemplary embodiments, improved tracking, curving and load leveling characteristics are achieved without adversely affecting hunting characteristics by changing the spring constant to be within a predetermined range, preferably between 4000–6000 lb/in.

In exemplary embodiments, a standardized set of three different springs are provided that can be mixed and matched in various combinations to achieve different preload values for use in a multitude of applications, while reducing the need for special, custom-designed springs for each application.

In exemplary embodiments, a better contact surface arrangement with a car body wear plate is achieved by coping the cap corners and increasing the flatness of the cap top contact surface to improve wear characteristics, such as reduced gouging.

BRIEF DESCRIPTION OF THE DRAWINGS

The invention will be described with reference to the following drawings, wherein:

FIG. 18 is a table of exemplary spring combinations usable with the claimed invention.

DETAILED DESCRIPTION OF PREFERRED EMBODIMENTS

Figure 1:
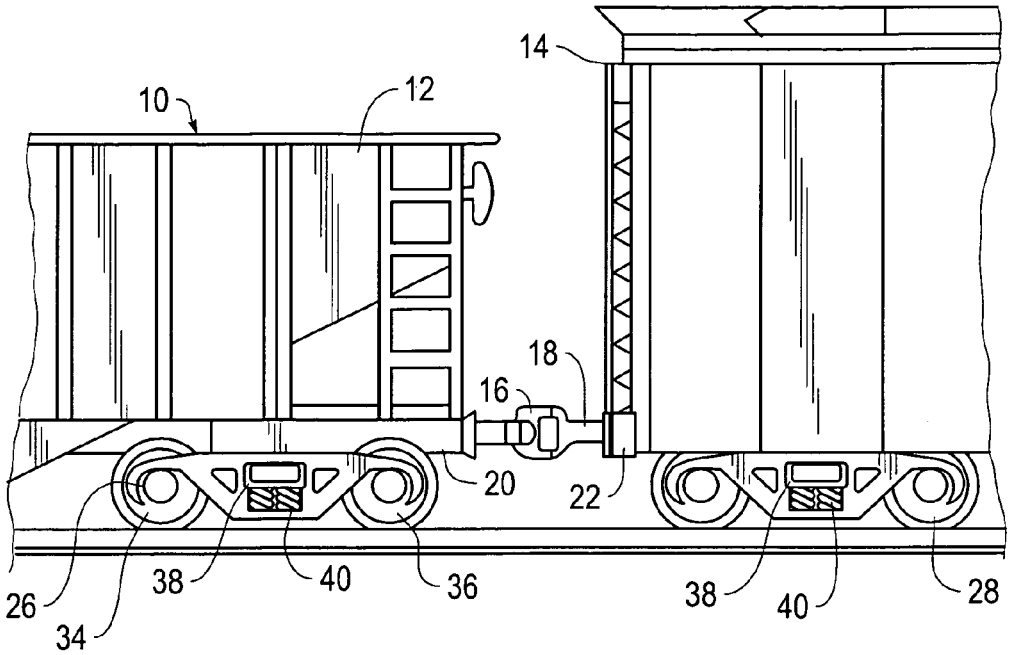
Fig. 1 PRIOR ART
FIG. 1 is a schematic elevation of the coupled ends of two typical railroad cars.
Figure 2:
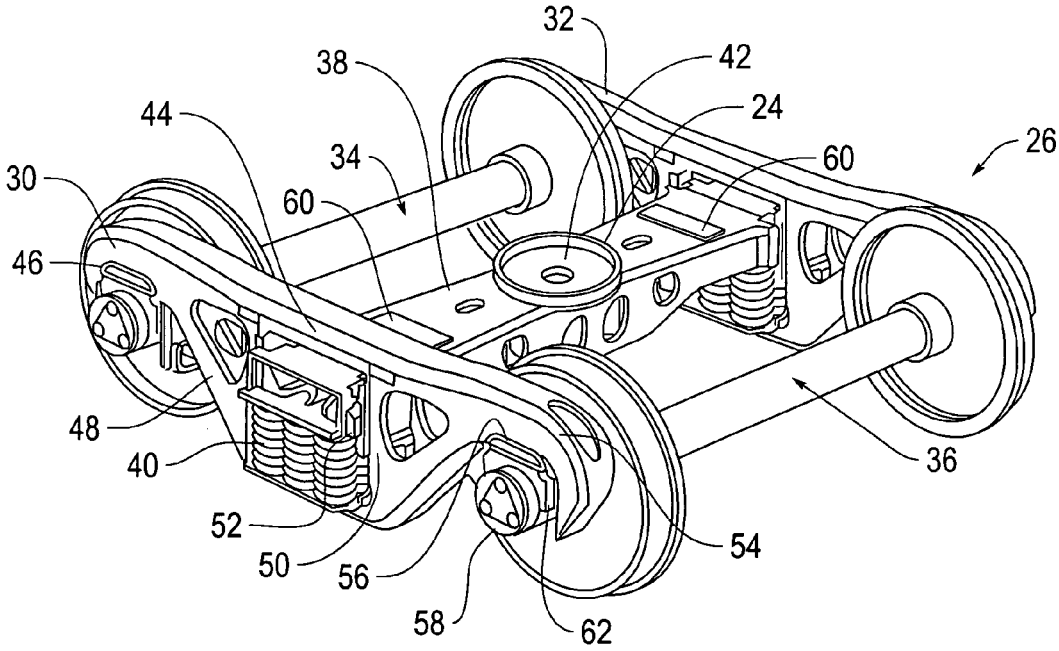
FIG. 2 is a perspective view of a typical railway car truck for use with the present invention.
Figure 3:
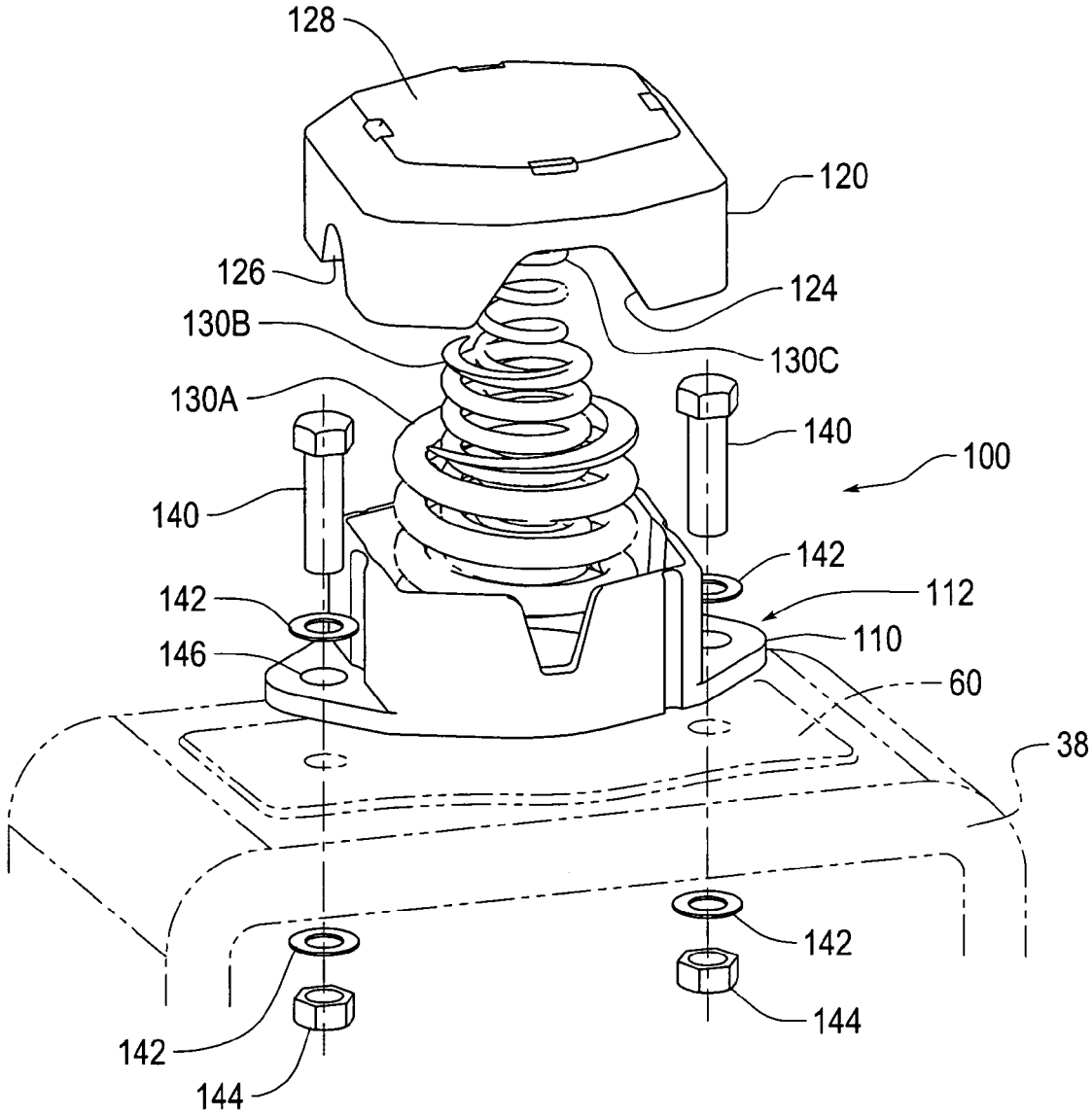
FIG. 3 is an exploded perspective view of an exemplary constant contact side bearing according to the invention.

A first embodiment of a side bearing according to the invention will be described with reference to FIGS. 3–8. Side bearing assembly 100 has a major longitudinal axis coincident with the longitudinal axis of a railway car. That is, when the side bearing is mounted on railway truck bolster 38 (only partially shown in FIG. 4), the major axis of the side bearing is perpendicular to the longitudinal axis of the bolster. Side bearing assembly 100 includes as main components, a base 110, a cap 120, and one or more resilient urging elements 130, such as a spring or elastomer element. In the exemplary embodiment shown, there are provided three springs, outer spring 130A, middle spring 130B and inner spring 130C that serve as the urging element, each of which may have a different spring constant to provide an overall combined load rating.

Base 110 is fixed to bolster 38 by suitable means. As shown, base 110 is bolted to bolster 38 by way of mounting bolts 140, washers 142 and mounting nuts 144 passing through mounting holes 146 provided on base flanges 112. Alternatively, base 110 could be riveted in place. Then, preferably, base 110 is not welded to bolster 38 along at least transverse sides.

Figure 4:
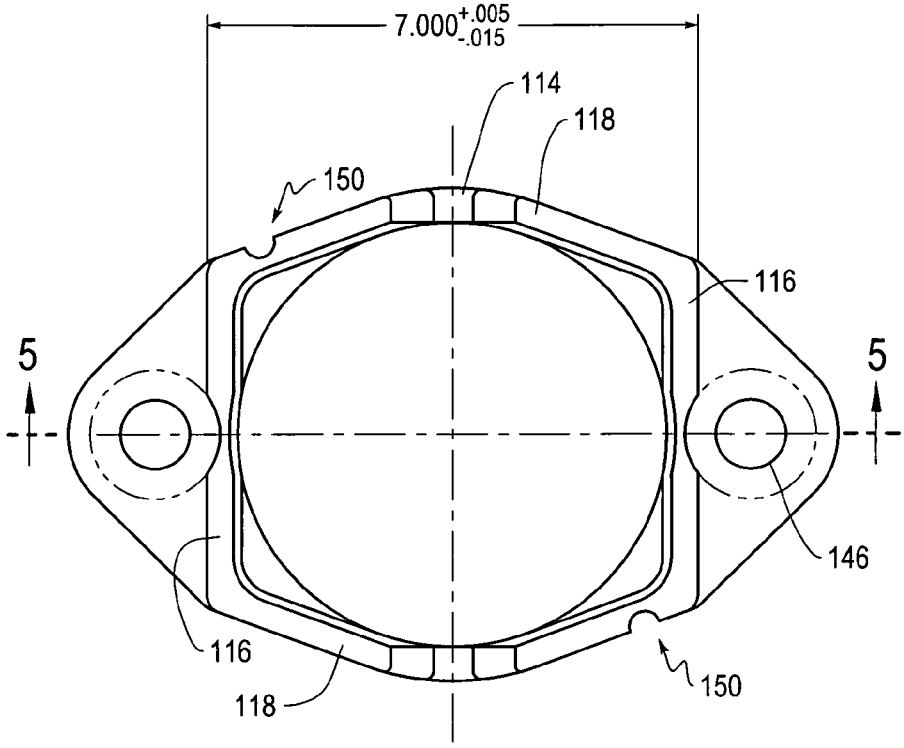
FIG. 4 is a top view of an exemplary base according to the invention.
Figure 5:
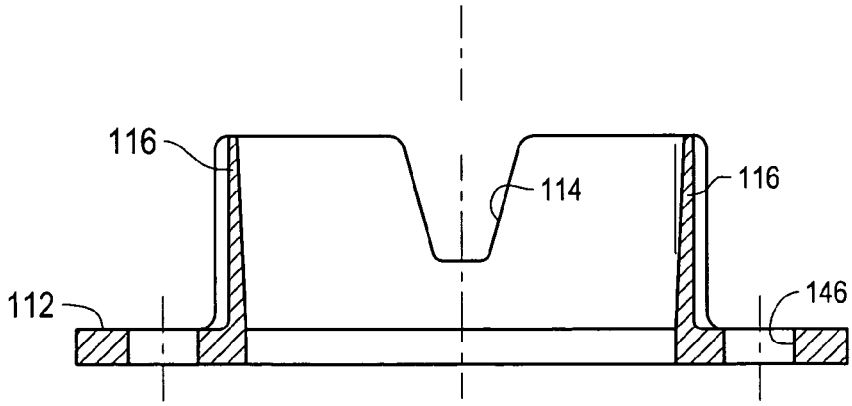
FIG. 5 is a cross-sectional view of the base of FIG. 4 taken along lines 5—5.

As best shown in FIGS. 4–5, base 110 has opposing side walls 116 and front and rear walls 118. Each of the front and rear walls 118 include a large, generally V-shaped opening 114. Opening 114 serves as a viewing window allowing visual inspection of the springs 130A–C during use of the side bearing. Opening 114 also serves to reduce weight of the base 110.

To increase the travel length of the side bearing, walls 116, 118 are reduced in total height by 5/16" from prior designs, such as that used in U.S. Pat. No. 3,748,001. This helps to achieve greater travel of the spring before cap 120 and base 10 mate and prevent further travel. In an exemplary embodiment, base 110 has a total height of 3.312" (±0.030), with walls 116, 118 extending approximately 2.812" above flange 112.

Figure 6:
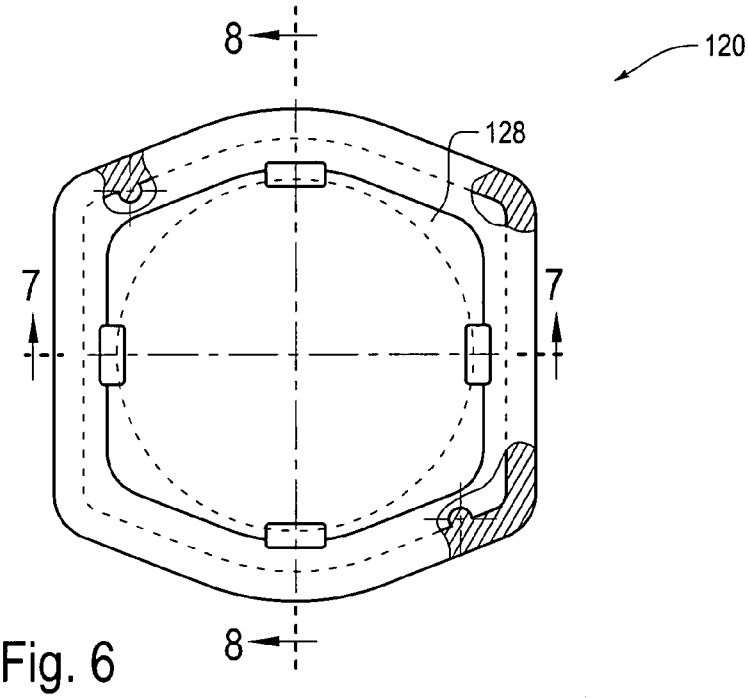
FIG. 6 is a top view of an exemplary cap according to the invention.
Figure 7:
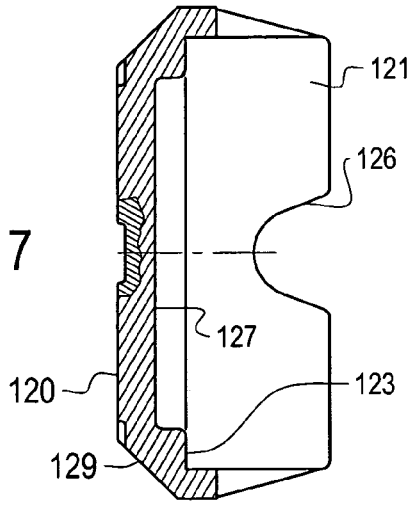
FIG. 7 is a cross-sectional view of the cap of FIG. 6 taken along lines 7—7.
Figure 8:
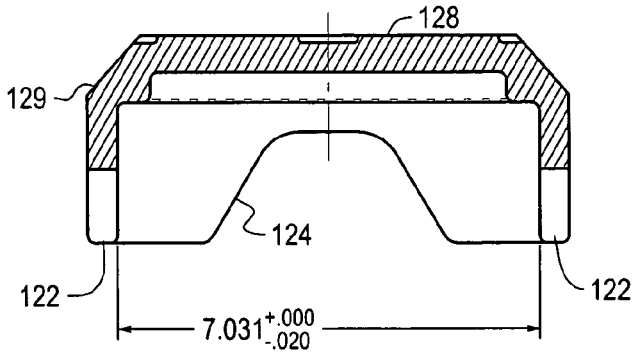
FIG. 8 is a cross-sectional view of the cap of FIG. 6 taken along lines 8—8 configured to receive one or a plurality of springs.

Referring to FIGS. 6–8, cap 120 is cup-shaped and includes downwardly extending side walls 121, and downwardly extending front and rear walls 122 that surround base 110 in a telescoping fashion. Side walls 121 are provided with a large, generally inverted V-shaped notch 124 corresponding in location with opening 114 on base 110 to assist in forming the viewing window. Front and rear walls 122 also include a notch 126. The downwardly extending walls 121, 122 of cap 120 overlap base 110 in such a fashion that even when the spring(s) 130 are at their free height or in an uncompressed condition, there is still provided an amount of overlap between walls 121, 122 and walls 116, 118. This eliminates the need for a retaining pin to prevent separation of the cap relative to the base.

Cap 120 is further provided with a top contact surface 128, lower stop surface 123, and lower recessed spring support surface 127. Preferably, all peripheral edges 129 are coped. This serves several purposes. It reduces weight of the cap. Moreover, by coping the corners, a better contact surface is made that abuts against a car body wear plate (unshown but located on the underside of a car body immediately above cap 120 in use). In particular, by having coped corners, it has been found that less gouging occurs on the car body wear plate when the cap slides and rotates in frictional engagement with the car body wear plate during use. To further assist in a better contact surface, top contact surface 128 is formed substantially flat, preferably within 0.010" concave or 0.030" convex to further improve wear characteristics. In particular, this bias reduces the chance of the edge "binding" against the wear plate and is easier to manufacture.

To assist in providing long travel of the springs, cap 120 is shortened similar to that of base 110. In an exemplary embodiment, cap 120 is shortened in height by 5/16" over previous designs to allow further travel of spring(s) 130 before cap 120 and base 110 mate and prevent further travel. Cap 120 preferably has a total cap height of 3.50", with side walls 121 and 122 extending downward approximately 2.88" below lower support surface 127. This allows the cap to overlap farther onto base 110 before sides 121, 122 hit flange 112.

As mentioned, the inventive side bearing cap 120 and base 110 can be used with one or more urging members, such as springs 130. To achieve long travel of at least 5/8", it is preferably to reduce the spring solid height from that used in prior designs. This is because prior spring designs would have gone solid before 5/8" of travel was achieved. That is, the individual spring coils would have compressed against each other so that no further compression was possible.

Many exemplary spring configurations were designed and tested. Suitable exemplary versions are provided in table form in FIG. 18. Each of these are capable of travel during use of at least 5/8" (0.625"). That is, each have a travel from a loaded height (such as 4.44") to a fully compressed height (such as 3.68") where the spring is fully compressed or the cap and base mate that equals or exceeds 5/8" of travel.

Although three springs per side bearing are described in many embodiments, the invention in not limited to this and fewer, or even more, springs could be used. In fact, the number and size of springs may be tailored for a particular application. For example, lighter cars will use a softer spring rate and may use softer springs or fewer springs. Similarly, multi-unit articulated cars may use lighter or fewer springs because such cars use four side bearings instead of two per car. As such, the load carrying capacity of each can be reduced. Also, it has been found that better performance can be achieved through use of substantially softer spring constants than previously used. This has been found to provide a suspension system with a slower reaction time, which has been found to achieve improved tracking and curving, without adversely affecting hunting. This also has been found to result in reduced sensitivity to set-up height variations or component tolerances so as to achieve a more consistent preload on the truck system. This tends to equalize the loading and allow a railcar to stay more level , with less lean or roll both statically and dynamically.

To obtain longer fatigue life, the material used for base 110 and cap 120 has been changed from Grade C steel to Grade E steel, which is harder and stronger. To assist in longer service life, hardened wear surfaces are provided on the outside surfaces of base walls 116.

Additionally, in an exemplary preferred embodiment, to prevent excessive movements and accelerated wear, reduced longitudinal clearances between cap 120 and base 110 are provided by reducing the tolerances from prior values. This can be achieved, for example, by more closely controlling the casting or other formation process of the cap 120 and base 110 side walls. In a preferred embodiment, base 110 has a longitudinal distance of 7.000" (+0.005/−0.015) between outside surfaces of side walls 116 and internal surfaces of side walls 122 of cap 120 have a longitudinal distance of 7.031" (+0.000/−0.020). This results in a closely controlled combined longitudinal spatial gap having a minimum of 0.006" and a maximum of 0.046." The minimum is achieved when base side walls 116 are at the maximum tolerance of 7.005" and the cap side walls 122 are at the minimum tolerance of 7.011." The maximum is achieved when the base side walls 116 are at the minimum tolerance of 6.985" and the cap side walls 122 are at the maximum tolerance of 7.031."

Also, it is important to keep the distance from top surface 128 to lower stop surface 123 at 1.125" (±0.030) so as to ensure travel of at least 5/8" before full compression of cap 120 on base 110.

Because of the possibility of various spring combinations, it is desirable to provide a safety feature that prevents interchangeability of improper components for a given application. To achieve this, exemplary embodiments provide keying features on both the cap 120 and base 110 to prevent mismatch of components. Also, caps 120 can be provided with spring lockout features that prevent improper combinations of springs to be used.

Figure 9:
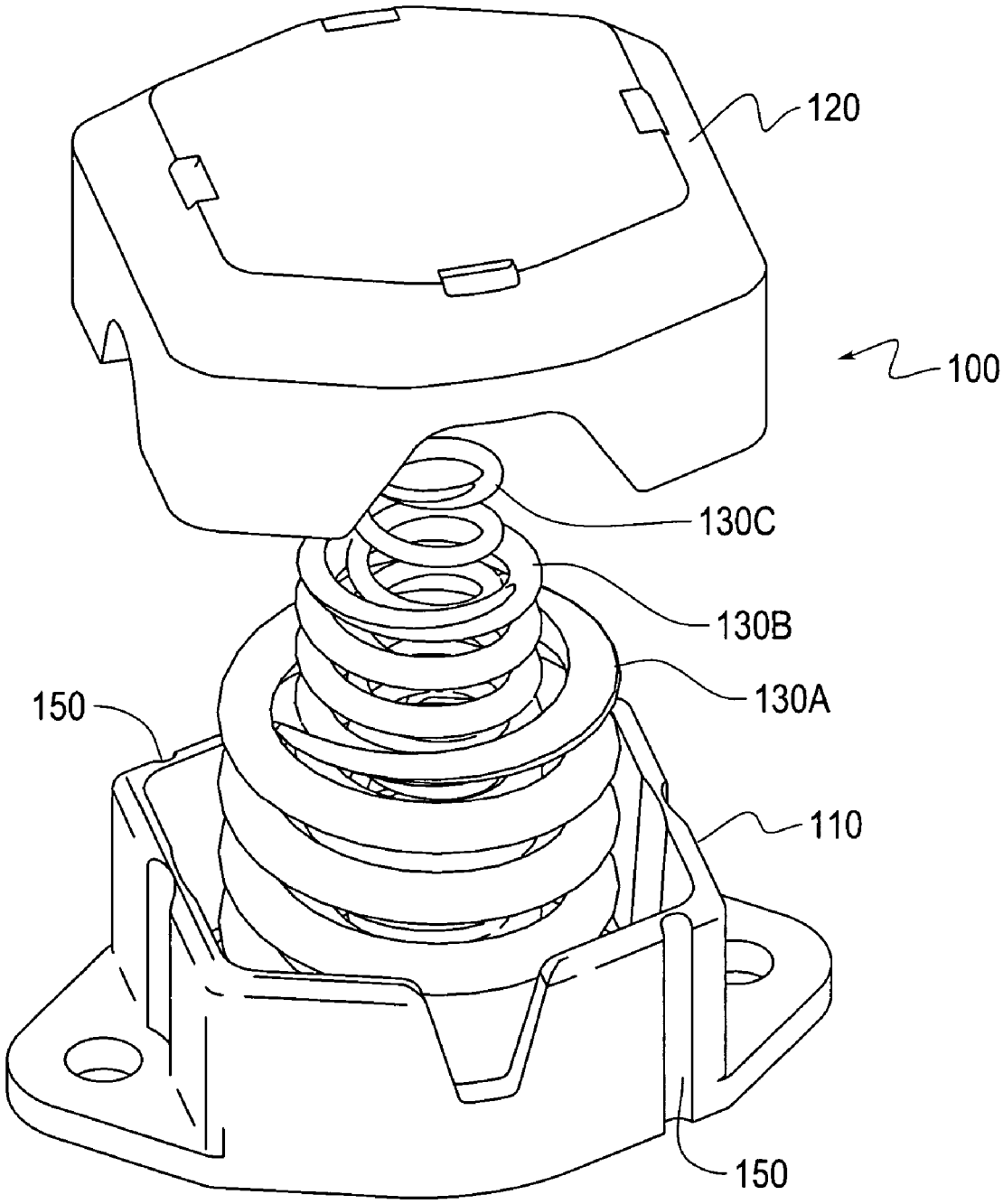
FIG. 9 is an exploded perspective view of a first exemplary constant contact side bearing with three springs and a cap with a first keying feature according to the invention.
Figure 10:
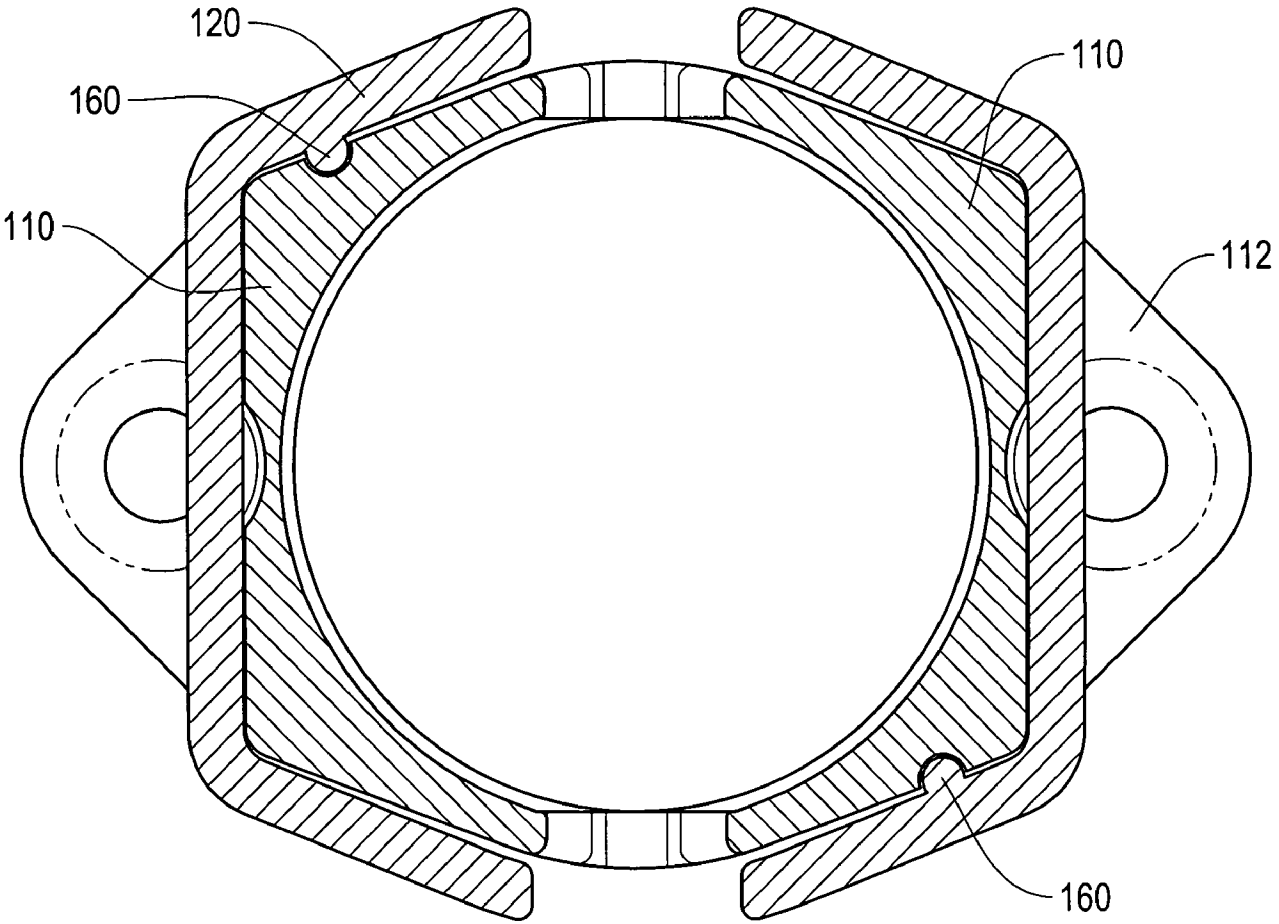
FIG. 10 is a cross-sectional view of the first exemplary side bearing of FIG. 9.

FIGS. 9–10 show a first exemplary embodiment in which all three springs 130A, 130B and 130C are used. This application would be used for heavier railcars and can use any of the three-spring combinations listed in FIG. 18. However, a preferred combination of springs is the bottom example in FIG. 18. Use of a three-spring combination is particularly suitable for railcars in excess of 50,000 lbs, typically between 50,000 lbs and 110,000 lbs. Such cars are often boxcars, steel coal cars, multi-level auto rack cars and the like.

This configuration includes a first keying feature configuration consisting of vertical half-circle recessed keying features 150 provided on opposite diagonal outside corners of base 110 and corresponding vertical half-circle protruding keying features 160 provided on corresponding inside corners of cap 120. With these keying features, base and caps for only this application will be allowed to mate and overlap. This prevents mismatching of components. Moreover, the keying features 150, 160 preferably prevent improper orientation of components. For example, the keying feature should preferably prevent use of a proper cap, but rotated 180° from a correct orientation.

Figure 11:
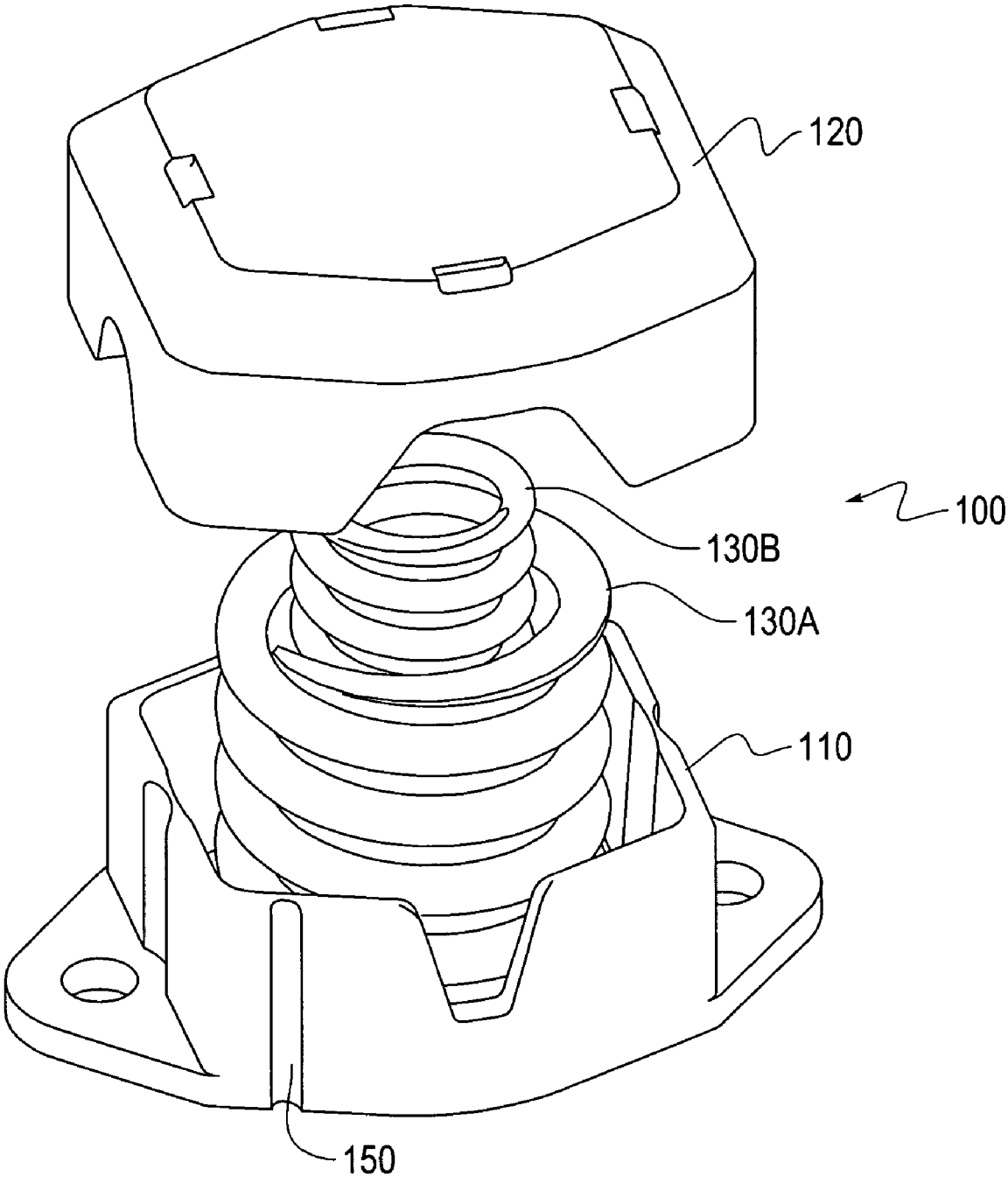
FIG. 11 is an exploded perspective view of a second exemplary constant contact side bearing with two springs and a cap having a second keying feature and a first exemplary spring lockout feature according to the invention.
Figure 12:
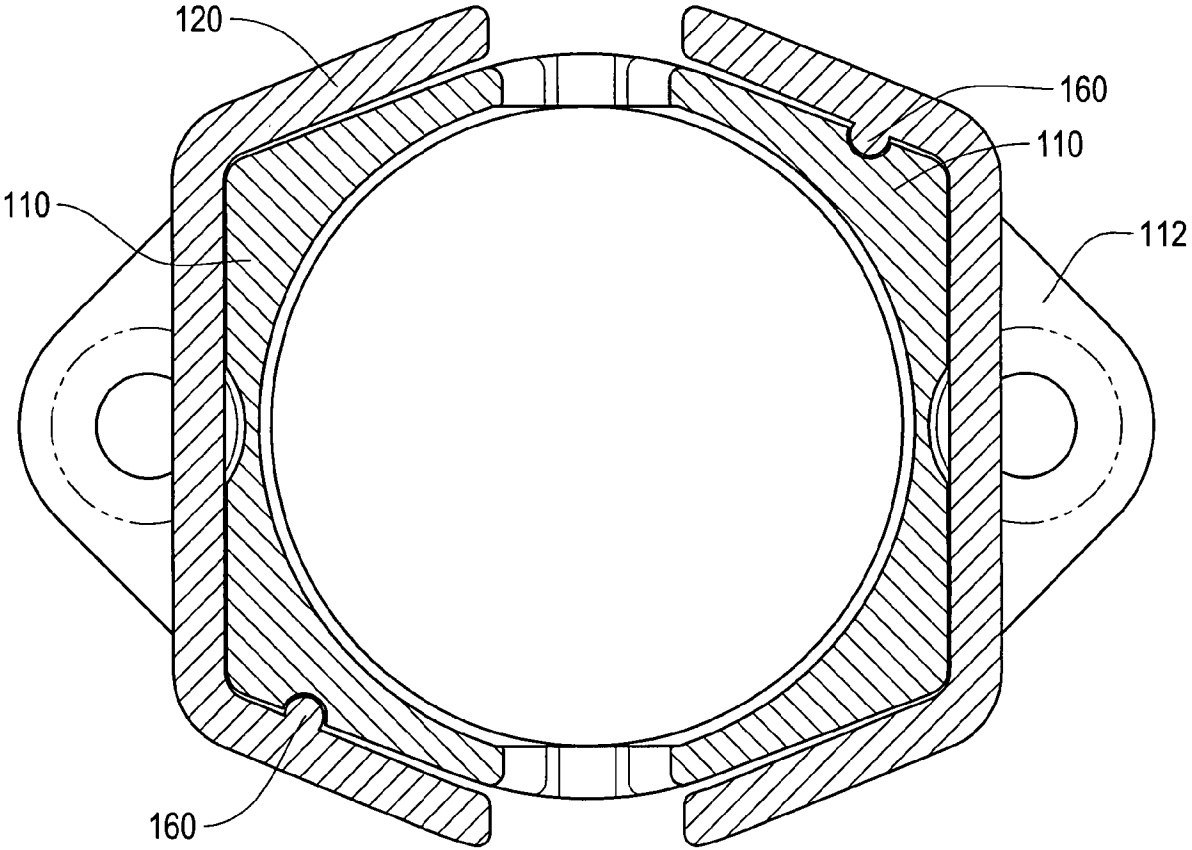
FIG. 12 is a cross-sectional view of the second exemplary side bearing showing the second keying structure according to the invention.

FIGS. 11–12 show a second exemplary embodiment in which only the two heavier springs 130A and 130B are used. This application would be used for medium weight railcars and can use any of the different outer and middle springs listed in FIG. 18. This combination of springs is particularly suited for railcars weighing between about 40,000 lbs. to 65,000 lbs.

This configuration includes a second keying feature configuration consisting of vertical half-circle recessed keying features 150 provided on different opposite diagonal outside corners of base 110 and corresponding vertical half-circle protruding keying features 160 provided on corresponding inside corners of cap 120. With these keying features, base and caps for only this application will be allowed to mate and overlap. This prevents mismatching of components. For example, even if rotated, cap 120 for this embodiment will not mate with the base of the previous embodiment.

Figure 13:
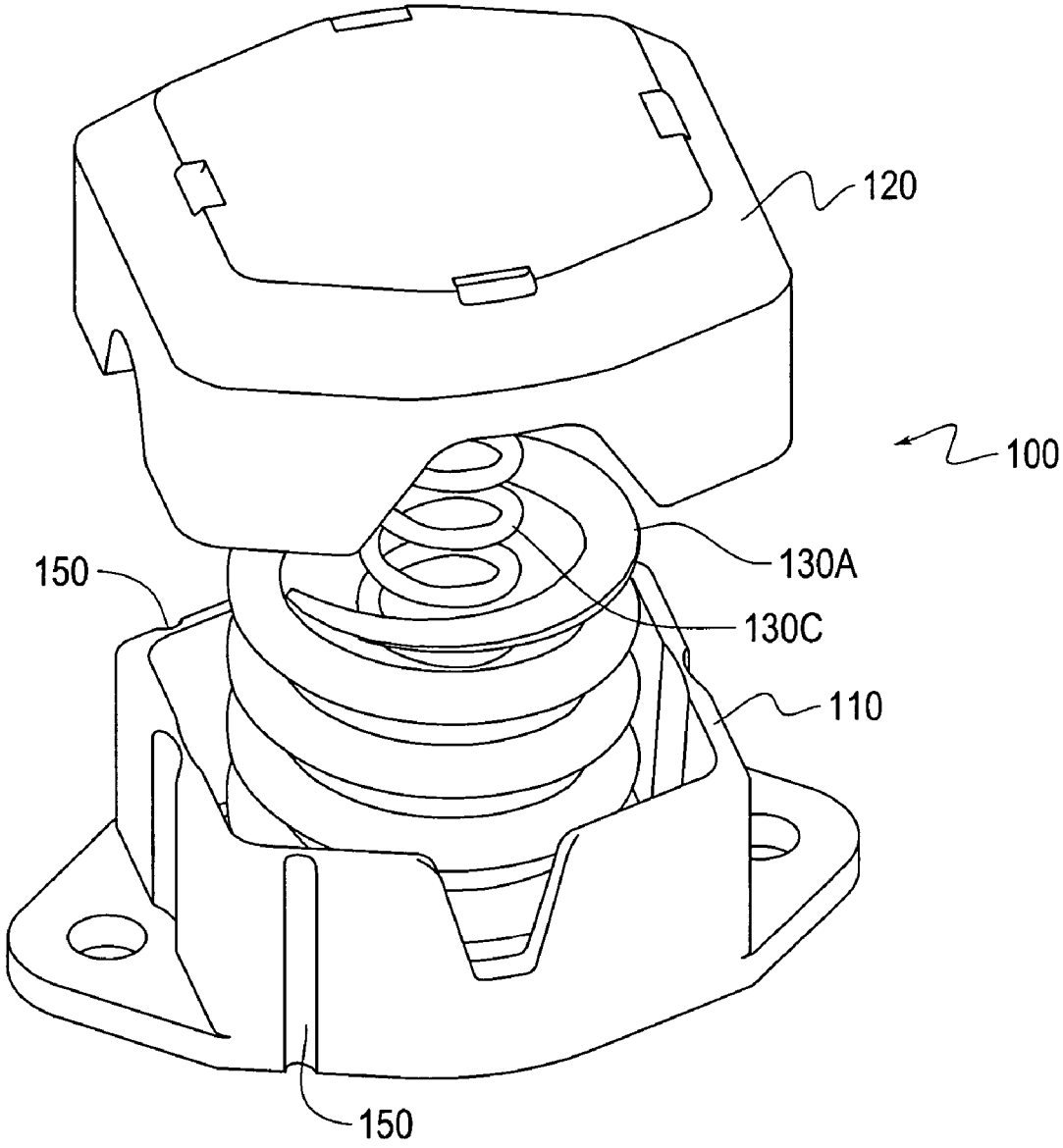
FIG. 13 is an exploded perspective view of a third exemplary constant contact side bearing with two springs and a cap with a third keying feature and a second exemplary spring lockout feature according to the invention.
Figure 14:
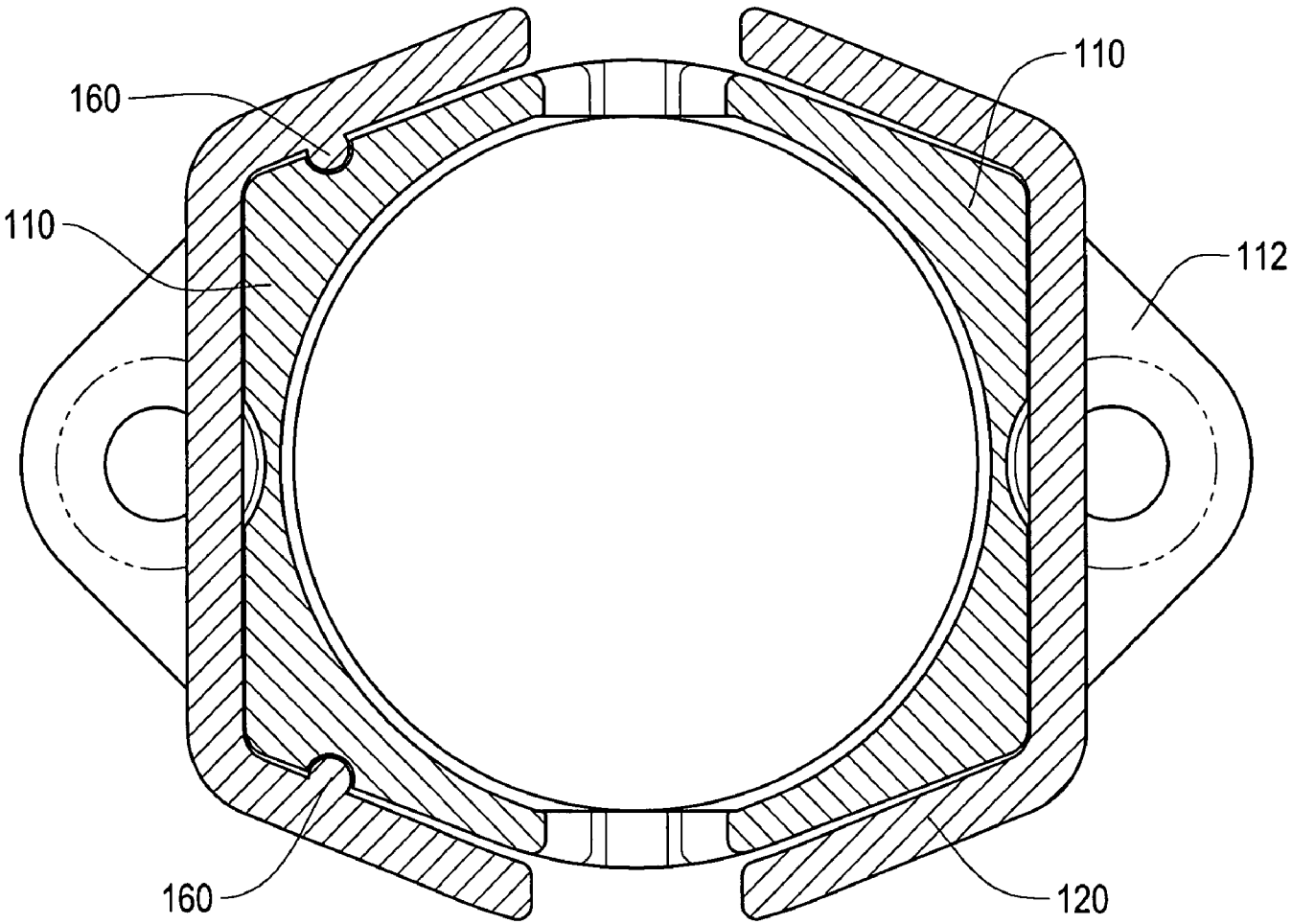
FIG. 14 is a cross-sectional view of the third exemplary side bearing showing the third keying structure according to the invention.

FIGS. 13–14 show a third exemplary embodiment in which only springs 130A and 130C are used. This application would be used for lighter railcars or multi-unit railcars and can use any of the different outer and inner spring combinations listed in FIG. 18. This combination of springs is particularly suited for use with railcars weighing less than about 45,000 lbs. It is also suited for use in center trucks of articulated cars, which use four side bearings per truck rather than the standard two. Because there are twice as many side bearings, the spring rate can be lower for each side bearing.

This configuration includes a first keying feature configuration consisting of vertical half-circle recessed keying features 150 provided on same-side opposite outside corners of base 110 and corresponding vertical half-circle protruding keying features 160 provided on corresponding inside corners of cap 120. With these keying features, base and caps for only this application will be allowed to mate and overlap. This prevents mismatching of components. For example, cap 120 of this embodiment will not fit on either of the previous two embodiments.

Figure 15:
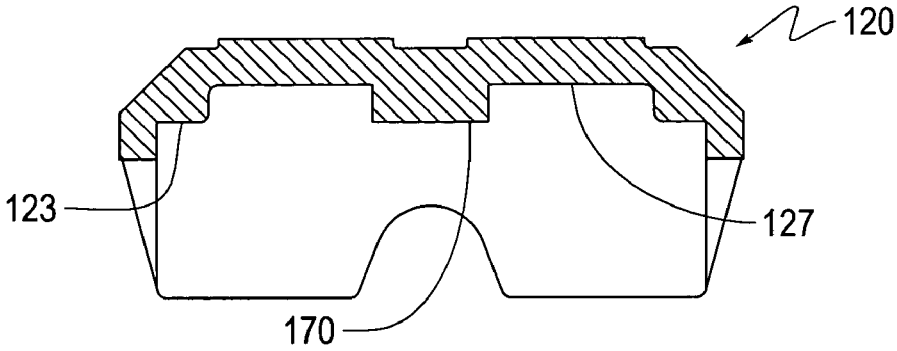
FIG. 15 is a cross-sectional view of the cap of FIG. 6 taken along lines 8—8 showing a first exemplary spring lockout configuration used with the side bearing of FIG. 11.
Figure 16:
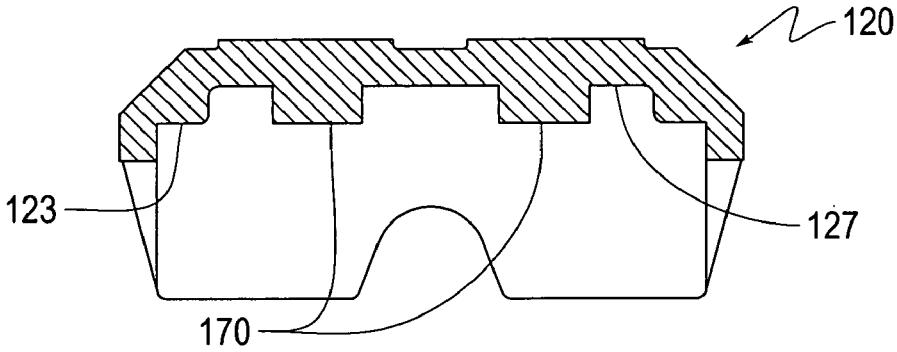
FIG. 16 is a cross-sectional view of the cap of FIG. 6 taken along lines 8—8 showing a second exemplary spring lockout configuration used with the side bearing of FIG. 13.
Figure 17:
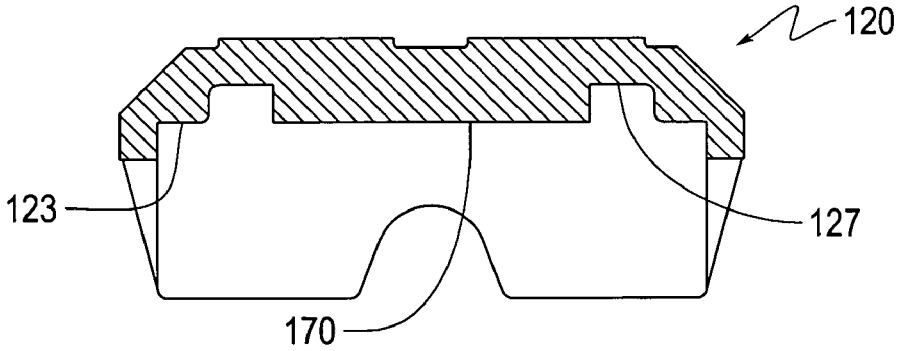
FIG. 17 is a cross-sectional view of the cap of FIG. 6 taken along lines 8—8 showing a third exemplary spring lockout configuration, useable with a single, large spring.

The use of the above keying features 150, 160 achieve proper matching of base and cap components. However, additional features are needed to ensure that the proper spring combinations are used for a particular application. The embodiment of FIGS. 9–10 uses all three springs. Because of this, there is no need for a spring lockout feature. As such, the underside of cap 120 in this embodiment will appear as in FIG. 8. However, in the FIGS. 11–12 embodiment, only the two outer springs 130A and 130B are used. To prevent usage of spring 130C, lower recessed spring support surface 127 of cap 120 in FIG. 15 is provided with a suitable spring lockout feature 170 that prevents insertion of an improper spring. In this case, spring lockout feature 170 may be a boss that protrudes downwardly and is sized to prevent use of small spring 130C, but is sized to not interfere with placement of springs 130A or 130B against spring support surface 127 on the interior of cap 120. Similarly, in the FIGS. 13–14 embodiment, lower recessed spring support surface 127 of cap 120 in FIG. 16 is provided with a second, exemplary spring lockout feature 170 that protrudes downwardly and prevents use of middle spring 130B, without interfering with placement of springs 130A or 130C. Other configurations of a spring lockout feature 170 are contemplated. For example, if only outer spring 130A was desired to be used, a third exemplary spring lockout feature 170 could be provided as in FIG. 17 to prevent use of both the inner and middle springs 130B and 130C. Thus, the combination of base and cap keying features 150, 160 and the spring lockout features 170 prevent interchanging of improper components for a particular application.

Additional advantages are achieved by use of specific spring constants in the inventive side bearing. Prior three-spring designs had dramatically higher spring constants, which were believed to be necessary to achieve proper load support and cushion to the railcar. For example, for a 65,000 lb. railcar many prior designs had a combined load rate of about 7100 lb/in (3705 lb/in for the outer spring, 2134 lb/in for the middle spring, and 1261 lb/in for the inner spring). The top example in FIG. 18 falls into this category. However, it has been found that substantially improved ride and load balancing characteristics can be achieved by dramatically reducing the load rate of the springs, in effect making them much softer. Many benefits can be achieved if the combined load rate is between about 4,000–6,000 lbs/in. If the rate is lowered much below 4,000 lb/in, it is possible that the side bearing will disengage from contact with the bottom of the car body, which is undesirable. As the load rate increases towards 6,000 lb/in, similar benefits can be achieved. However, the higher in this range, the more sensitive the springs are to manufacturing tolerance and set-up deviations.

A preferred embodiment according to the invention is shown at the bottom of FIG. 18 and uses a total combined load rate of about 4506 lb/in (2483 lb/in for the outer spring, 1525 lb/in for the middle spring, and 498 lb/in for the inner spring). A spring combination near the bottom of the preferred range of 4,000–6,000 lb/in. has been found particularly suitable for several reasons. First, it allows the side bearing to become less sensitive to set-up height variations and tolerances. That is, small deviations from one side bearing to another on a truck have been found to have little effect on the achieved preload. Thus, a spring with this range of preload has been found to be capable of a more consistent preload from side bearing to side bearing, even if there are minor set-up height or other tolerance variations or non-uniformities. This tends to equalize the loading and allow a railcar to stay more level, with less lean or roll both statically and dynamically. Second, such lowered rates provide a suspension system with a slower reaction time, which has been found to achieve improved tracking and curving, without adversely affecting hunting. However, as mentioned, increased spring rates approaching 6,000 lb/in. can be used. However, to achieve similar performance, various design tolerances must be more tightly controlled, because as the spring rate increases towards 6,000 lb/in., the sensitivity to set-up and tolerance variances increases. Thus, without appropriate control of these tolerances, such deviations may result in unlevel loading, resulting in undesirable lean of the car body from a flat state if one side bearing on the truck is not set-up the same as the other.

This combination of features has also achieved great weight reduction from prior designs. For example, the exemplary side bearing 100 has been found to have a weight of only 47.3 pounds, which is down from 55.9 pounds of prior designs.

While only specific embodiments of the invention have been described and shown, it is apparent that various alternatives and modifications can be made thereto. Those skilled in the art will also recognize that certain additions can be made in these illustrative embodiments. It is, therefore, the intention in the appended claims to cover all such alternatives, modifications and additions as may fall within the true scope of the invention.

What is claimed is:

1. A long travel, constant contact side bearing for use in a railway car truck, comprising:

a generally rectangular base having opposing side walls, a front wall, and a rear wall;

a generally rectangular cup-shaped cap having downwardly extending side walls, a front wall and a rear wall that surround the respective side walls, front wall and rear wall of the base in a telescoping fashion with a predetermined spatial gap therebetween, at least in the fore/aft direction, precisely controlled to be between 0.006" to 0.046" to achieve improved control, hunting and wear characteristics; and at least two coil springs provided within the base extending between the base and the cap, the at least two coil springs having a combined load rating between about 4000 to 6,000 lb/in, and a travel length from a loaded static height to a fully compressed solid height of at least ⅝", wherein the walls of the cap and base are configured so as to retain an overlap at the loaded static height state and allow at least ⅝" of spring travel length before parts of the cap and base abut each other and prevent further spring travel.

2. The long travel side bearing of claim 1, wherein the top surface of the cap includes a substantially flat surface that mates with each of the front, rear and side walls of the cap through flat, non-zero acute intersecting surfaces that reduce gouging on railway car body contact surfaces during use.

3. The long travel side bearing of claim 2, wherein the top surface has a flatness to within about 0.010" concave and 0.030" convex.

4. The long travel side bearing of claim 1, wherein the cap and base are formed from Grade E steel.

5. The long travel side bearing of claim 1, wherein at least select outside surfaces of the base side walls, front wall and/or rear wall have hardened wear surfaces.

6. The long travel side bearing of claim 1, wherein corresponding side walls of the base and cap include respective vertically-oriented openings and notches to form a side viewing window that allows visual inspection of the at least one spring.

7. The long travel side bearing of claim 1, wherein the side walls of the base and the side walls of the cap are substantially arcuate in profile and the front and rear walls are substantially flat in profile.

8. The long travel side bearing of claim 1, wherein an exterior of the base and an interior of the cap have complementary keying features located substantially on a diagonal to the fore/aft direction of the side bearing when mounted in the railway car truck to prevent mismatch or improper orientation of components.

9. The long travel side bearing of claim 8, wherein keying features are provided on two opposite sides to prevent improper orientation of the cap relative to the base.

10. The long travel side bearing of claim 8, wherein a first side bearing assembly for a first railway car application includes a first keying feature with a predetermined configuration, and a second side bearing assembly for a second, different railway car application includes a second keying feature different from the first keying feature, such that components from the first side bearing assembly and the second side bearing assembly cannot be improperly mismatched.

11. The long travel side bearing of claim 10, wherein the combined spring load rate of the first side bearing assembly differs from the combined spring load rate of the second side bearing assembly.

12. The long travel side bearing of claim 11, further comprising a spring lockout feature on at least one of the cap and base to prevent use of an improper spring with the first and second side bearing assemblies.

13. The long travel side bearing of claim 12, wherein available springs have different diameters, and the spring lockout feature prevents acceptance of an improperly sized spring.

14. The long travel side bearing of claim 1, wherein the at least two or more springs have a different diameter, the two or more springs each having a spring load rating sufficiently low that the combined spring load rating is between about 4,000 to 6,000 lb/in.

15. The long travel side bearing according to claim 14, wherein the combined spring load rating is about 4500 lb/in.

16. A long travel, constant contact side bearing for use in a railway car truck, comprising:

a generally rectangular base having opposing side walls, a front wall, and a rear wall;

a generally rectangular cup-shaped cap having a substantially flat top surface, downwardly extending side walls, a front wall and a rear wall that surround the respective side walls, front wall and rear wall of the base in a telescoping fashion with a predetermined spatial gap therebetween precisely controlled to be between about 0.006" to 0.046 to improve control and hunting characteristics of the railway car truck, the top surface mating with each of the front, rear and side walls of the cap through flat, non-zero acute intersecting surfaces that reduce gouging on railway car body contact surfaces during use; and at least two resilient urging members provided within the base extending between the base and the cap, the at least one urging member having a combined load rating between about 4,000 to 6,000 lb/in, and a travel length from a loaded static height to a fully compressed solid height of at least ⅝", wherein the walls of the cap and base are configured so as to retain an overlap at the loaded static height state and allow at least ⅝" of spring travel length before parts of the cap and base abut each other and prevent further travel.

17. The long travel side bearing of claim 16, wherein the resilient urging member includes at least one coil spring.

18. The long travel side bearing of claim 16, wherein an exterior of the base and an interior of the cap have complementary keying features located substantially on a diagonal to the fore/aft direction of the side bearing when mounted in the railway car truck to prevent mismatch or improper orientation of components.

19. The long travel side bearing of claim 16, further comprising a spring lockout feature on at least one of the cap and base to prevent use of an improper resilient urging member.

20. A long travel, constant contact side bearing for use in a railway car truck, comprising:

a base having opposing side walls, a front wall, and a rear wall;

a cup-shaped cap having downwardly extending side walls, a front wall and a rear wall that surround the respective side walls, front wall and rear wall of the base in a telescoping fashion with a predetermined spatial gap therebetween precisely controlled to be between about 0.006" to 0.046" to improve control and hunting characteristics of the railway car truck, a top surface of the cap including a substantially flat surface that mates with each of the front, rear and side walls of the cap through flat, non-zero acute intersecting surfaces that reduce gouging on railway car body contact surfaces during use; and at least two resilient urging members provided within the base extending between the base and the cap, the at least two urging members having a combined load rating between about 4,000 to 6,000 lb/in, and a travel length from a loaded static height to a fully compressed solid height of at least ⅝", wherein the walls of the cap and base are configured so as to retain an overlap at the loaded static height state and allow at least ⅝" of spring travel length before parts of the cap and base abut each other and prevent further spring travel.

21. A long travel, constant contact side bearing for use in a railway car truck, comprising:

a base having opposing side walls, a front wall, and a rear wall;

a cup-shaped cap having downwardly extending side walls, a front wall and a rear wall that surround the respective side walls, front wall and rear wall of the base in a telescoping fashion with a predetermined spatial gap therebetween precisely controlled to be between about 0.006" to 0.046" to improve control and hunting characteristics of the railway car truck, the top surface of the cap including a substantially flat surface that mates with each of the front, rear and side walls of the cap through flat, non-zero acute intersecting surfaces that reduce gouging on railway car body contact surfaces during use;

at least two coil springs provided within the base extending between the base and the cap, the at least two coil springs having a combined load rating between about 4,000 to 6,000 lb/in, and a travel length from a loaded static height to a fully compressed solid height of at least ⅝", wherein the walls of the cap and base are configured so as to retain an overlap at the loaded static height state and allow at least ⅝" of spring travel length before parts of the cap and base abut each other and prevent further spring travel, corresponding side walls of the base and cap include respective vertically-oriented openings and notches to form a side viewing window that allows visual inspection of the at least one spring, an exterior of the base and an interior of the cap have complementary keying features located substantially on a diagonal to the fore/aft direction of the side bearing when mounted to the railway car truck to prevent mismatch or improper orientation of components, a spring lockout feature is provided on at least one of the cap and base to prevent use of an improper spring with the first and second side bearing assemblies, the top surface of the cap includes a substantially flat surface that mates with each of the front, rear and side walls of the cap through flat, non-zero acute intersecting surfaces that reduce gouging on railway car body contact surfaces during use, the cap and base are formed from Grade E steel, and at least select outside surfaces of the base side walls, front wall and/or rear wall have hardened wear surfaces.

* * * * *